US008976101B2

(12) United States Patent
Chang et al.

(10) Patent No.: US 8,976,101 B2
(45) Date of Patent: Mar. 10, 2015

(54) LIQUID CRYSTAL DISPLAY DEVICE AND METHOD OF DRIVING THE SAME

(75) Inventors: Chung-Ok Chang, Gyeongbuk (KR); Seok-Su Kim, Gyeongbuk (KR); Kwang-Won Yang, Seoul (KR)

(73) Assignee: LG Display Co., Ltd., Seoul (KR)

( * ) Notice: Subject to any disclaimer, the term of this patent is extended or adjusted under 35 U.S.C. 154(b) by 1328 days.

(21) Appl. No.: 11/605,205

(22) Filed: Nov. 28, 2006

(65) Prior Publication Data

US 2007/0126686 A1 Jun. 7, 2007

(30) Foreign Application Priority Data

Nov. 28, 2005 (KR) ..... 10-2005-0114262

(51) Int. Cl.
*G09G 3/36* (2006.01)

(52) U.S. Cl.
CPC ..... *G09G 3/3648* (2013.01); *G09G 2310/0245* (2013.01); *G09G 2330/02* (2013.01); *G09G 2330/027* (2013.01); *G09G 2330/12* (2013.01)
USPC ..... 345/99; 345/98

(58) Field of Classification Search
None
See application file for complete search history.

(56) References Cited

U.S. PATENT DOCUMENTS

| | | | | |
|---|---|---|---|---|
| 6,417,829 | B1 * | 7/2002 | Jung et al. | 345/98 |
| 7,015,903 | B2 * | 3/2006 | Lee | 345/212 |
| 2002/0039153 | A1 * | 4/2002 | Yoo | 348/730 |
| 2003/0122765 | A1 * | 7/2003 | Yoon | 345/94 |
| 2004/0100435 | A1 * | 5/2004 | Baek et al. | 345/98 |
| 2006/0050027 | A1 * | 3/2006 | Meguro et al. | 345/75.2 |

OTHER PUBLICATIONS

Search Report dated Mar. 8, 2007 for corresponding Great Britain Patent Application No. GB0623765.5.

* cited by examiner

*Primary Examiner* — Kathy Wang-Hurst
*Assistant Examiner* — Jose Soto Lopez
(74) *Attorney, Agent, or Firm* — Brinks Gilson & Lione

(57) ABSTRACT

A display device includes a display panel including a gate line and a data line, a gate driver that outputs a gate voltage to the gate line according to a gate output enable signal, a data driver that outputs a data voltage to the data line, a detecting circuit that detects a state of a clock signal. The state of the clock signal includes a normal or abnormal state. A masking circuit performs a masking operation for the gate output enable signal according to the state of the clock signal and a level of a reset signal, where the level of the reset signal includes a first or second level corresponding to a power-on or off of the display device, respectively.

22 Claims, 3 Drawing Sheets

LIQUID CRYSTAL DISPLAY DEVICE AND METHOD OF DRIVING THE SAME

This application claims the benefit of priority of Korean Patent Application No. 2005-0114262, filed on Nov. 28, 2005, which is hereby incorporated by reference for all purposes as if fully set forth herein.

BACKGROUND

1. Technical Field

The present invention relates to a liquid crystal display device, and more particularly, to a liquid crystal display device and method for driving the same.

2. Discussion of the Related Art

Conventionally, cathode-ray tubes (CRTs) may be used as display devices. Presently, much effort is being made to study and develop various types of flat panel displays, such as liquid crystal display (LCD) devices, plasma display panels (PDPs), field emission displays (FED), and electro-luminescence displays (ELDs), as a substitute for CRTs. These flat panel displays may be driven by an active matrix driving method in which a plurality of pixels arranged in a matrix configuration are driven using a plurality of thin film transistors therein. Among these active matrix type flat panel displays, liquid crystal display (LCD) devices and electroluminescent display (ELD) devices are widely used for notebook computers and desktop computers because of their high resolution, ability to display colors and superiority in displaying moving images.

In general, an LCD device includes two substrates that are spaced apart and face each other with a layer of liquid crystal molecules interposed between the two substrates. The two substrates include electrodes that face each other such that a voltage applied between the electrodes induces an electric field across the layer of liquid crystal molecules. The alignment of the liquid crystal molecules changes based on an intensity of the induced electric field, thereby changing the light transmissivity of the LCD device. Thus, the LCD device displays images by varying the intensity of the electric field across the layer of liquid crystal molecules.

FIG. 1 is a schematic view illustrating an LCD device according to the related art. Referring to FIG. 1, the LCD device includes a liquid crystal panel 100 and a driving circuit. The driving circuit includes gate and data drivers 110 and 120, a timing controller 130 and a masking circuit 140. The liquid crystal panel 100 includes a plurality of gate lines GL1 to GLn and a plurality of data lines DL1 to DLm crossing each other to define a plurality of pixels P. Each pixel P includes a thin film transistor T and a liquid crystal capacitor Clc. The liquid crystal capacitor Clc includes a pixel electrode, a common electrode and a liquid crystal layer between the pixel and common electrodes.

The timing controller 130 is supplied with synchronization signals to generate control signals to control the gate and data drivers 110 and 120. The timing controller 130 processes data signals and supplies those to the data driver 120. The gate driver 110 is supplied with control signals such as a gate shift clock (GSC), a gate output enable (GOE) signal and a gate start pulse (GSC). The gate driver 110 sequentially outputs gate voltages to the gate lines GL1 to GLn. The gate lines GL1 to GLn are sequentially enabled by one horizontal line, and the thin film transistors T connected to the enabled gate line GL1 to GLn are turned on.

The data driver 120 is supplied with the data signals and control signals such as a source sampling clock (SSC), a source output enable (SOE) signal, a source start pulse (SSP) and a polarity reverse (POL) signal. The data driver 120 outputs data voltages by one horizontal line to the data lines DL1 to DLm when the gate line GL1 to GLn is enabled.

The masking circuit 140 performs a masking operation according to a reset signal RE supplied from the timing controller 130. The masking operation is to make the GOE signal have a high level to block an output of the gate driver 110.

FIG. 2 is a waveform view illustrating a masking operation according to the related art. Referring go FIG. 2, when a reset signal RE has a high level, a masking operation is performed for a GOE signal. When the reset signal RE has a low level, the masking operation is not performed for the GOE signal. The reset signal RE has a low level when a power of the LCD device is off. The reset signal RE has a high level because the power is on. However, a predetermined time period may occur for the control signals for circuits to have a normal state. In other words, before the predetermined time period, even though the reset signal RE has a high level, the control signals may not have a normal state. Accordingly, there occurs an abnormal image display. For example, a screen of the LCD device may be displayed in a white or black.

To resolve this problem, the masking circuit (140 of FIG. 1) masks the GOE signal additionally during three or four frame periods from the power-on point, and then, when the control signals have a normal state, the gate driver (110 of FIG. 1) is made normally output gate voltages. In other words, during the low-level time period of the reset signal RE and the predetermined time period, the GOE signal (GOE_IN) input to the masking circuit is masked and the output of the gate driver is blocked. Then, the masking circuit outputs the GOE signal (GOE_OUT) as the GOE signal is input thereto.

Various events in the related art LCD device may have control signals supplied to the gate and data drivers that may not have a normal state during a predetermined time period from a starting point of the events, such as a channel change, an input signal change, a sound erasure and the like. However, when the various events happen, the abnormal image display is still caused in the related art LCD device.

SUMMARY

A display device includes a display panel including a gate line and a data line; a gate driver that outputs a gate voltage to the gate line according to a gate output enable signal; a data driver that outputs a data voltage to the data line; a detecting circuit detects a state of a clock signal, the state of the clock signal including a normal or abnormal; and a masking circuit performs a masking operation for the gate output enable signal based on the state of the clock signal and a level of a reset signal, the level of the reset signal including a first or second level corresponding to a power-on or off of the display device, respectively.

A method of driving a display device includes outputting a gate voltage to a gate line of a display panel from a gate driver according to a gate output enable signal; outputting a data voltage to a data line of the display panel from a data driver; detecting a state of a clock signal, the state of the clock signal including a normal or abnormal; and performing a masking operation for the gate output enable signal based the state of the clock signal and a level of a reset signal, the level of the reset signal including a first and second level corresponding to a power-on or off of the LCD device, respectively.

A display device is also disclosed that includes a display panel including a gate line and a data line; a gate driver that outputs a gate voltage to the gate line according to a gate output enable signal; a data driver that outputs a data voltage to the data line; a detecting circuit that detects a state of a clock signal, the state of the clock signal including a normal or abnormal; and a masking circuit that modifies or passes the gate output enable signal to the gate driver based on the state of the clock signal and a power-on or off of the display device, respectively, wherein the gate output enable signal is modified to disable the gate driver during the abnormal state of the clock signal and a predetermined time period from after the abnormal state of the clock signal is changed into the normal state of the clock signal and when the power is on.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION

Reference will now be made in detail to embodiments of the present invention, example of which are illustrated in the accompanying drawings.

Figure 1:
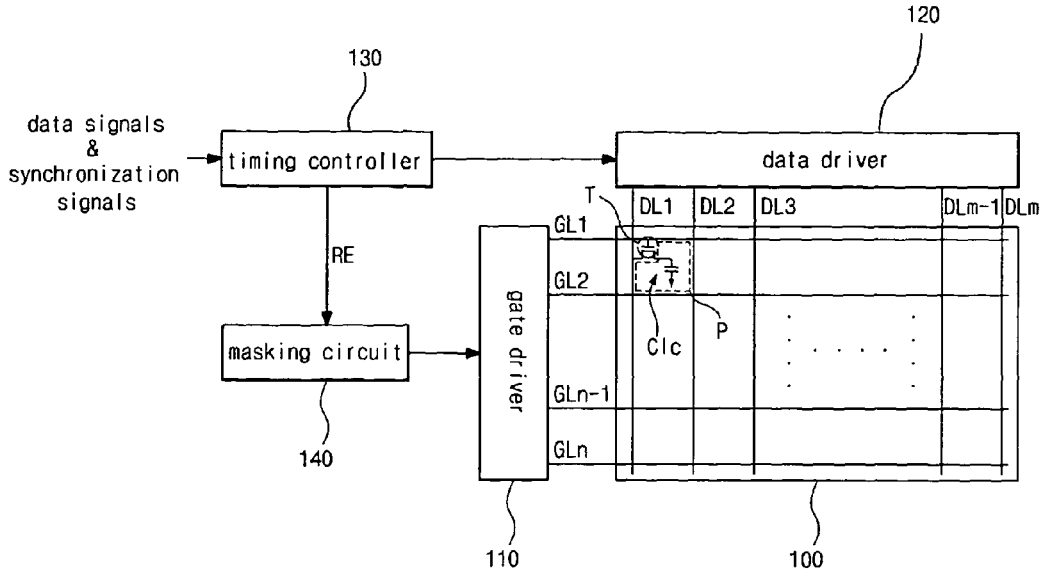
FIG. 1 RELATED ART
FIG. 1 is a schematic view illustrating an LCD device according to the related art.
Figure 2:
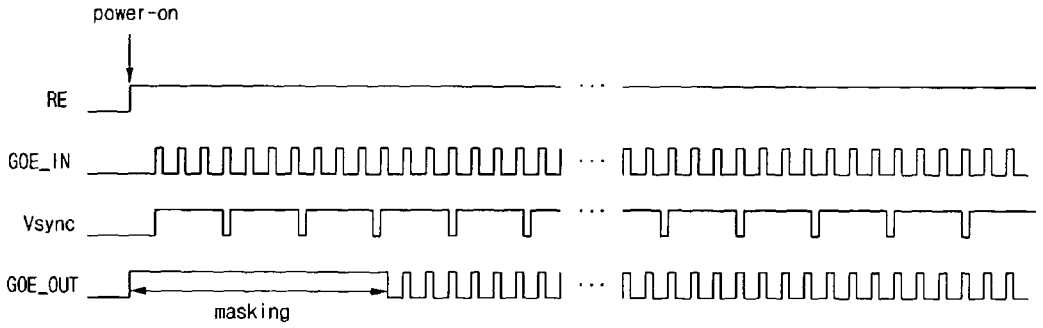
FIG. 2 RELATED ART
FIG. 2 is a waveform view illustrating a masking operation according to the related art.
Figure 3:
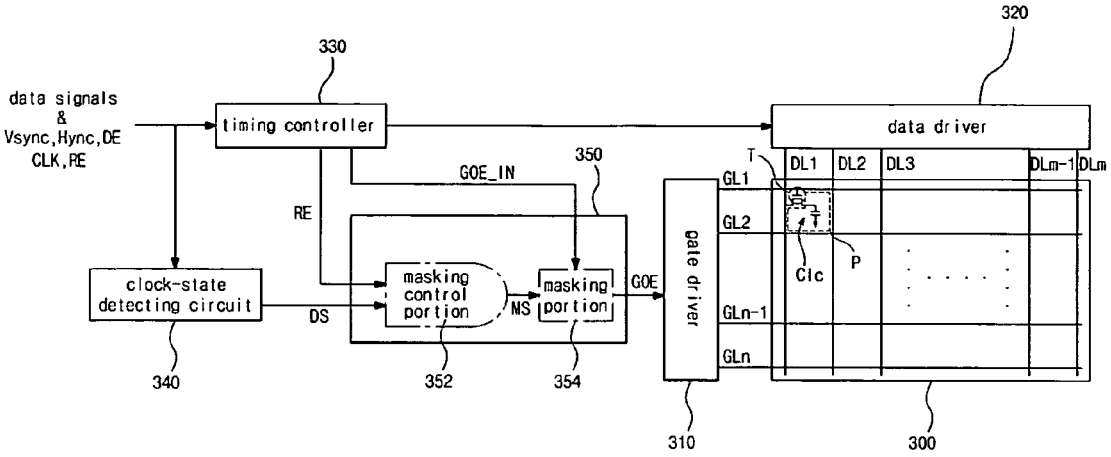
FIG. 3 is an example block diagram illustrating an LCD device.

FIG. 3 illustrates an example LCD device. The LCD device includes a liquid crystal panel 300 and a driving circuit. The driving circuit includes gate and data drivers 310 and 320, a timing controller 330, a clock-state detecting circuit 340 and a masking circuit 350. The clock-state detecting circuit 340 and the masking circuit 350 may be included in the timing controller 330.

The liquid crystal panel 300 includes a plurality of gate lines GL1 to GLn and a plurality of data lines DL1 to DLm crossing each other to define a plurality of pixels P. Each pixel P includes a thin film transistor T and a liquid crystal capacitor Clc. The liquid crystal capacitor Clc includes a pixel electrode, a common electrode and a liquid crystal layer between the pixel and common electrodes.

The timing controller 330 is supplied with synchronization signals, such as a vertical synchronization signal Vsync and a horizontal synchronization signal Hsync, a clock signal CLK, a data enable signal DE and a reset signal RE to generate control signals to control the gate and data drivers 310 and 320 from an external system. The timing controller 330 processes data signals and supplies those to the data driver 320.

The gate driver 310 is supplied with control signals such as a gate shift clock (GSC), a gate output enable (GOE) signal and a gate start pulse (GSC) and sequentially outputs gate voltages to the gate lines GL1 to GLn. The gate lines GL1 to GLn are sequentially enabled by one horizontal line, and the thin film transistors T connected to the enabled gate line GL1 to GLn are turned on.

The data driver 320 is supplied with data signals and control signals such as a source sampling clock (SSC), a source output enable (SOE) signal, a source start pulse (SSP) and a polarity reverse (POL) signal. The data driver 320 outputs data voltages by one horizontal line to the data lines DL1 to DLm when each gate line GL1 to GLn is enabled.

The clock-state detecting circuit 340 is supplied with the clock signal CLK from the timing controller 330. The clock-state detecting circuit 340 detects a state of the clock signal CLK to output a detecting signal DS.

Figure 4:
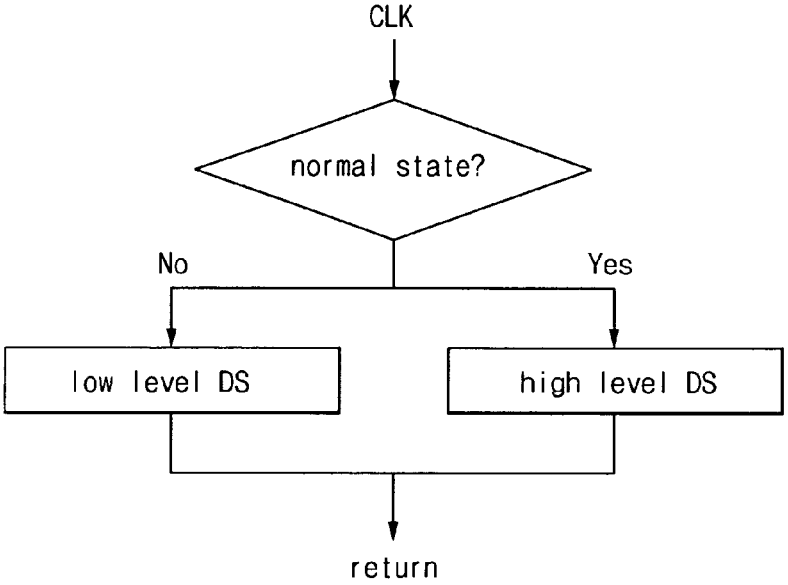
FIG. 4 is an example flow chart illustrating a detecting operation of a clock-state detecting circuit of FIG. 3.
Figure 5:
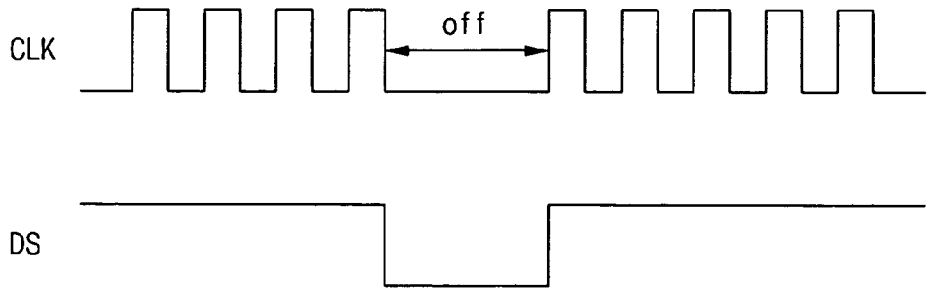
FIG. 5 is an example waveform view illustrating a clock signal and a detecting signal input to and output from a clock-state detecting circuit of FIG. 3.

Referring to FIGS. 4 and 5, when the clock signal CLK has a normal state, the clock-state detecting circuit 340 outputs the detecting signal DS having a first level, for example, a high level. When the clock signal CLK has an abnormal state, the clock-state detecting circuit 340 outputs the detecting signal DS having a second level, for example, a low level. The abnormal state of the clock signal CLK is, for example, a no-clock-signal-input state that the clock signal CLK is not input to the timing controller 130.

The clock signal CLK is a reference signal to control a timing of the driving circuit and is a rectangular-shaped signal having regular amplitude and wavelength. The clock signal CLK is not supplied when various events causing control signals to have an abnormal state, for example, a channel change, an input signal change, a sound erasure and the like, happen. Accordingly, when the various events happen, the clock signal CLK is not input, and the clock-state detecting circuit 340 can detect the abnormal state of the clock signal CLK.

The masking circuit 350 includes a masking control portion 352 and a masking portion 354. The masking control portion 352 is supplied with the detecting signal DS and the reset signal RE to output a masking control signal MS. The masking control portion 352 may have a logic unit, for example, an AND Gate unit. The AND Gate unit outputs the masking control signal MS having a high level, for example, a logic value "1" when the detecting signal DS and the reset signal RE both have a high level. The AND Gate unit outputs the masking control signal MS having a low level, for example, a logic value "0" when the detecting signal DS and the reset signal RE does not both have a high level i.e., at least one of the detecting signal DS and the reset signal RE has a low level. The masking portion 354 performs a masking operation for an input GOE signal (GOE_IN) from the timing controller 330 according to the masking control signal MS.

Figure 6:
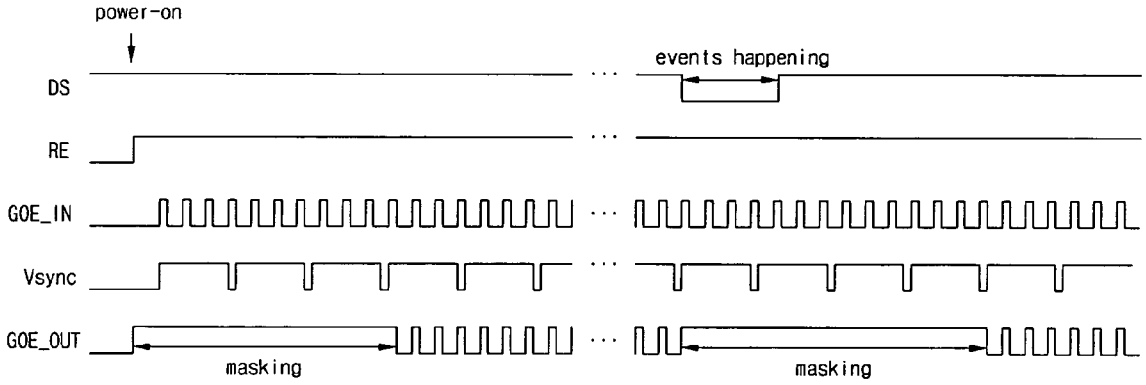
FIG. 6 is an example waveform view illustrating a masking operation in the LCD device.

When the masking control signal MS has a low level, the masking operation is performed for the input GOE signal (GOE_IN). When the masking control signal MS has a high level, the masking operation is not performed for the input GOE signal (GOE_IN). In more detail, referring to FIG. 6, the masking portion 354 masks the input GOE signal (GOE_IN) during a low level of the masking control signal MS and additionally during a predetermined time period from when a low level of the masking control signal MS is changed into a high level. The predetermined time period may be three or four frame periods. The masking operation for various events starts when a high level of the masking control signal MS is changed into a low level of the masking control signal MS. In other words, the masking operation is performed during the abnormal state of the clock signal and during the predetermined time period when the power is on.

As explained above, the masking control signal MS has a low level when the detecting signal DS and/or the reset signal RE have a low level, and the masking control signal MS has a high level when the detecting signal DS and the reset signal RE both have a high level. The detecting signal DS has a low level when the clock signal CLK has an abnormal state, and the reset signal RE has a low level when the power of the LCD device is off. The detecting signal DS has a high level when the clock signal CLK has a normal state, and the reset signal RE has a high level when the power is on. Accordingly, during the predetermined time period from when the power is on and the clock signal CLK has a normal state, the masking operation is additionally performed. During the masking operation, the masking portion 354 modifies the input GOE signal (GOE_IN) and outputs an output GOE signal (GOE_OUT) having a level, for example, a high level to block an output of the gate driver 310. Accordingly, during the masking operation, the gate driver 310 is supplied with the output GOE signal (GOE_OUT) having a high level and does not output the gate voltages to the gate lines GL1 to GLn. As a result, not only when the power is on but also when the various events that the control signals may not have a normal state happen, images can be prevented from being abnormally displayed.

When the masking portion 354 does not perform the masking operation, the masking portion 354 passes the input GOE signal (GOE_IN) and the input GOE signal (GOE_IN) is output from the masking portion 354 as the output GOE signal (GOE_OUT).

An example method of driving an LCD device is explained with reference to FIGS. 3 to 6. The clock-state detecting circuit 340 detects a state of the clock signal CLK from the timing controller 330 to output the detecting signal DS. When the clock signal CLK has a normal state, the clock-state detecting circuit 340 outputs the detecting signal DS having a high level. When the clock signal CLK has an abnormal state, the clock-state detecting circuit 340 outputs the detecting signal DS having a low level. Because the clock signal CLK is not supplied when the various events, such as a channel change, an input signal change, a sound erasure and the like, happen, the clock-state detecting circuit 340 can detect the normal or abnormal state of the clock signal CLK.

The masking circuit 350 performs the masking operation using the detecting signal DS and the reset signal RE. The masking control portion 352 performs a logical operation for the detecting signal DS and the reset signal RS to output the masking control signal MS. For example, the masking control portion 352 outputs the masking control signal MS having a high level when the detecting signal DS and the reset signal RE both have a high level, and outputs the masking control signal MS having a low level when at least one of the detecting signal DS and the reset signal RE has a low level.

The masking portion 354 performs the masking operation for the input GOE signal (GOE_IN) from the timing controller 330 according to the masking control signal MS. The masking portion 354 masks the input GOE signal (GOE_IN) during a low level of the masking signal MS and the predetermined time period from when a low level of the masking signal MS is changed into a high level. Accordingly, during the masking operation, the masking portion 354 modifies the input GOE signal (GOE_IN) and outputs the output GOE signal (GOE_OUT) having a high level to disable the gate driver 310. During a non-masking operation, the masking portion 354 transfers the input GOE signal to the gate driver 310 to enable the gate driver 310.

The gate driver 310 is turned off and does not output the gate voltages to the gate lines GL1 to GLn during the masking operation to prevent the abnormal image display due to the abnormal state of the control signals. The gate driver 310 is normally operated and outputs the gate voltages to the gate lines GL1 to GLn after the masking operation. The data driver 320 outputs the data voltages to the data lines DL1 to DLm. During the masking operation, the data driver 320 may not output the data voltages.

As explained above, the LCD device not only detects the power-on or off but also the normal or abnormal state of the clock signal. Accordingly, not only when the power is on but also when the various events that the control signals may not have a normal state happen, images can be normally displayed.

The embodiment of the present invention can be applicable to other type display devices, for example, an OLED device and a PDP.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

a display panel including a gate line and a data line;

a gate driver configured to output a gate voltage to the gate line based on a gate output enable signal;

a data driver configured to output a data voltage to the data line;

a detecting circuit configured to detect a state of a clock signal, wherein the state of the clock signal comprises a normal state or an abnormal state;

a masking circuit configured to perform a masking operation for the gate output enable signal based on the state of the clock signal and a level of a reset signal, wherein the masking circuit performs the masking operation during the abnormal state of the clock signal and a predetermined time period after the abnormal state of the clock signal is changed into the normal state of the clock signal and when the power is on; and a timing controller configured to generate control signals, that are supplied to and control the gate driver and the data driver, based on the clock signal and transfer the reset signal to the masking circuit, wherein the control signals that control the gate driver include a gate shift clock, wherein the detecting circuit and the timing controller are supplied in common with the clock signal as an input from an external system.

2. The device of claim 1, wherein the detecting circuit outputs a detecting signal having a third level and a fourth level corresponding to the normal state and the abnormal state of the clock signal, respectively.

3. The device of claim 2, wherein the masking circuit includes a masking control portion configured to output a masking control signal using the reset signal and the detecting signal, and a masking portion configured to perform the masking operation based on the masking control signal.

4. The device of claim 3, wherein the masking control signal has a fifth level when the reset signal has the first level and the detecting signal has the third level and has a sixth level at other cases, and the masking circuit performs the masking operation during a predetermined time period after the sixth level of the masking control signal is changed into the fifth level of the masking control signal.

5. The device of claim 1, wherein the display panel comprises a liquid crystal panel.

6. The device of claim 1, wherein the level of the reset signal comprises a first level or a second level corresponding to a power-on state or a power-off state of the display device, respectively.

7. A method of driving a display device, comprising:

outputting a gate voltage to a gate line of a display panel from a gate driver based on a gate output enable signal;

outputting a data voltage to a data line of the display panel from a data driver;

detecting a state of a clock signal through a detecting circuit, the state of the clock signal comprising a normal state or an abnormal state;

performing a masking operation for the gate output enable signal when the power is on and during the abnormal state of the clock signal and a predetermined time period after the abnormal state of the clock signal is changed into the normal state of the clock signal, and wherein the masking operation is based on a level of a reset signal through a masking circuit; and generating control signals, which are supplied to and control the gate driver and the data driver, through a timing controller based on the clock signal that transfers the reset signal to the masking circuit, wherein the control signals that control the gate driver include a gate shift clock, wherein the detecting circuit and the timing controller are supplied in common with the clock signal as an input from an external system.

8. The method of claim 7, further comprising generating a detecting signal having a third level and a fourth level corresponding to the normal state and the abnormal state of the clock signal, respectively.

9. The method of claim 8, further comprising generating a masking control signal using the reset signal and the detecting signal, wherein the masking operation is performed according to the masking control signal.

10. The method of claim 9, wherein the masking control signal has a fifth level when that the reset signal has the first level and the detecting signal has the third level and has a sixth level at other cases, and wherein performing the masking operation comprises performing the masking operation during a predetermined time period after the sixth level of the masking control signal is changed into the fifth level of the masking control signal.

11. The method of claim 7, wherein the display panel comprises a liquid crystal panel.

12. The method of claim 7, wherein the level of the reset signal comprises a first level and a second level corresponding to a power-on state or a power-off state of the display device, respectively.

13. A display device, comprising:

a display panel including a gate line and a data line;

a gate driver configured to output a gate voltage to the gate line based on a gate output enable signal;

a data driver configured to output a data voltage to the data line;

a detecting circuit configured to detect a state of a clock signal, the state of the clock signal comprising a normal state or an abnormal state;

a masking circuit configured to modify or pass the gate output enable signal to the gate driver based on the state of the clock signal and a power-on state or power-off state of the display device, respectively; and a timing controller configured to generate control signals, that are supplied to and control the gate driver and the data driver, based on the clock signal and transfer the reset signal to the masking circuit, wherein the control signals that control the gate driver include a gate shift clock, wherein the detecting circuit and the timing controller are supplied in common with the clock signal as an input from an external system, and wherein the gate output enable signal is modified to disable the gate driver during the abnormal state of the clock signal and a predetermined time period after the abnormal state of the clock signal is changed into the normal state of the clock signal and when the power is on.

14. The device of claim 13, wherein the gate output enable signal is passed to enable the gate driver after the predetermined time period.

15. An apparatus that drives a display device, comprising:

means for outputting a gate voltage to a gate line of a display panel based on a gate output enable signal;

means for outputting a data voltage to a data line of the display panel;

means for detecting a state of a clock signal, the state of the clock signal comprising a normal state or an abnormal state;

means for performing a masking operation for the gate output enable signal based on a first level of a reset signal and a second level of the reset signal, wherein the means for performing the masking operation are configured to perform the masking operation when the power is on and during the abnormal state of the clock signal and a predetermined time period after the abnormal state of the clock signal is changed into the normal state of the clock signal; and a timing controller configured to generate control signals, that are supplied to and control the means for outputting the gate voltage and the means for outputting the data voltage, based on the clock signal and transfer the reset signal to the means for performing the masking operation, wherein the control signals that control the means for outputting the gate voltage include a gate shift clock, wherein the means for detecting the state of the clock signal and the timing controller are supplied in common with the clock signal as an input from an external system.

16. The apparatus of claim 15, further comprising means for generating a detecting signal having a third level and a fourth level corresponding to the normal state and the abnormal state of the clock signal, respectively.

17. The apparatus of claim 16, further comprising means for generating a masking control signal using the reset signal and the detecting signal, wherein the means for performing the masking operation are configured to perform the masking operation based on the masking control signal.

18. The apparatus of claim 17, wherein the masking control signal has a fifth level when that the reset signal has the first level and the detecting signal has the third level and has a sixth level at other cases, and wherein the means for performing the masking operation are configured to perform the masking operation during a predetermined time period after the sixth level of the masking control signal is changed into the fifth level of the masking control signal.

19. The apparatus of claim 15, wherein the display panel comprises a liquid crystal panel.

20. The apparatus of claim 15, wherein the first level of the reset signal and the second level of the reset signal correspond to a power-on state or a power-off state of the display device, respectively.

21. A display apparatus, comprising:

a display panel including a gate line and a data line;

means for outputting a gate voltage to the gate line based on a gate output enable signal;

means for outputting a data voltage to the data line;

means for detecting a state of a clock signal, the state of the clock signal comprising a normal state or an abnormal state;

means for modifying or passing the gate output enable signal to the means for outputting a gate voltage based on the state of the clock signal and a power-on state or a power-off state of the display device, respectively; and a timing controller configured to generate control signals, that are supplied to and control the means for outputting the gate voltage and the means for outputting the data voltage, based on the clock signal and transfer the reset signal to the means for modifying or passing the gate output enable signal, wherein the control signals that control the means for outputting the gate voltage include a gate shift clock, wherein the means for detecting the state of the clock signal and the timing controller are supplied in common with the clock signal as an input from an external system, and wherein the gate output enable signal is modified to disable the means for outputting a gate voltage during the abnormal state of the clock signal and a predetermined time period after the abnormal state of the clock signal is changed into the normal state of the clock signal and when the power is on.

22. The apparatus of claim 21, wherein the gate output enable signal is passed to enable the means for outputting a gate voltage after the predetermined time period.

* * * * *